US008522579B2

(12) United States Patent
Kappler

(10) Patent No.: US 8,522,579 B2
(45) Date of Patent: Sep. 3, 2013

(54) CLOTHES WASHER DEMAND RESPONSE WITH DUAL WATTAGE OR AUXILIARY HEATER

(75) Inventor: Jerrod Aaron Kappler, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/899,920

(22) Filed: Oct. 7, 2010

(65) Prior Publication Data

US 2011/0061175 A1 Mar. 17, 2011

Related U.S. Application Data

(63) Continuation-in-part of application No. 12/559,751, filed on Sep. 15, 2009.

(51) Int. Cl.
*D06F 33/00* (2006.01)
*D06F 35/00* (2006.01)

(52) U.S. Cl.
USPC ..... 68/12.02; 8/158

(58) Field of Classification Search
USPC ..... 8/158; 68/12.02
See application file for complete search history.

(56) References Cited

U.S. PATENT DOCUMENTS

| | | | |
|---|---|---|---|
| 2,545,054 | A | 3/1951 | Stitz |
| 3,683,343 | A | 8/1972 | Feldman et al. |
| 3,720,073 | A | 3/1973 | McCarty |
| 4,048,812 | A | 9/1977 | Thomason |
| 4,167,786 | A | 9/1979 | Miller et al. |
| 4,190,756 | A | 2/1980 | Foerstner |
| 4,216,658 | A | 8/1980 | Baker et al. |
| 4,247,786 | A | 1/1981 | Hedges |
| 4,362,970 | A | 12/1982 | Grady |
| 4,454,509 | A | 6/1984 | Buennagel et al. |
| 4,637,219 | A | 1/1987 | Grose |
| 4,659,943 | A | 4/1987 | Virant |
| 4,718,403 | A | 1/1988 | McCall |
| 4,731,547 | A | 3/1988 | Alenduff et al. |

(Continued)

FOREIGN PATENT DOCUMENTS

| | | | |
|---|---|---|---|
| CN | 1692317 | A | 11/2005 |
| CN | 101013979 | A | 8/2007 |

(Continued)

OTHER PUBLICATIONS

PCT/US2009/056919 International Search Report.

(Continued)

*Primary Examiner* — Michael Barr
*Assistant Examiner* — Charles W Kling
(74) *Attorney, Agent, or Firm* — Global Patent Operation

(57) ABSTRACT

A clothes washer is provided comprising one or more power consuming functions and a controller in signal communication with an associated utility. The controller can receive and process a signal from the associated utility indicative of current state of an associated utility. The controller operates the clothes washer in one of a plurality of operating modes, including at least a normal operating mode and an energy savings mode in response to the received signal. In the case of a water heating clothes washer containing a heater assembly, the controller is configured to change the power consuming characteristics of the heater assembly to reduce power consumption of the clothes washer in an energy savings mode.

4 Claims, 5 Drawing Sheets

(56) References Cited

U.S. PATENT DOCUMENTS 4,903,502 A 2/1990 Hanson et al.
4,998,024 A 3/1991 Kirk et al.
5,040,724 A 8/1991 Brinkruff et al.
5,137,041 A 8/1992 Hall et al.
5,183,998 A 2/1993 Hoffman et al.
5,220,807 A 6/1993 Bourne et al.
5,224,355 A 7/1993 So et al.
5,230,467 A 7/1993 Kubsch et al.
5,289,362 A 2/1994 Liebl et al.
5,408,578 A 4/1995 Bolivar
5,430,430 A 7/1995 Gilbert
5,451,843 A 9/1995 Kahn et al.
5,462,225 A 10/1995 Massara et al.
5,479,157 A 12/1995 Suman et al.
5,479,558 A 12/1995 White et al.
5,481,140 A 1/1996 Maruyama et al.
5,495,551 A 2/1996 Robinson et al.
5,504,306 A 4/1996 Russell et al.
5,505,377 A 4/1996 Weiss
5,515,692 A 5/1996 Sterber et al.
5,574,979 A 11/1996 West
5,581,132 A 12/1996 Chadwick
5,635,895 A 6/1997 Murr
5,706,191 A 1/1998 Bassett et al.
5,761,083 A 6/1998 Brown et al.
5,816,491 A 10/1998 Berkeley et al.
5,866,880 A 2/1999 Seitz et al.
5,874,902 A 2/1999 Heinrich et al.
5,880,536 A 3/1999 Mardirossian
5,883,802 A 3/1999 Harris
5,886,647 A 3/1999 Badger et al.
5,926,776 A 7/1999 Glorioso et al.
5,937,942 A 8/1999 Bias et al.
5,956,462 A 9/1999 Langford
6,018,150 A 1/2000 Maher
6,026,651 A 2/2000 Sandelman
6,080,971 A 6/2000 Seitz
6,118,099 A 9/2000 Lake
6,179,213 B1 1/2001 Gibino et al.
6,185,483 B1 2/2001 Drees
6,229,433 B1 5/2001 Rye et al.
6,246,831 B1 6/2001 Seitz et al.
6,380,866 B1 4/2002 Sizer et al.
6,400,103 B1 6/2002 Adamson
6,480,753 B1 11/2002 Calder et al.
6,489,597 B1 12/2002 Hornung
6,553,595 B1 4/2003 Bruntz et al.
6,631,622 B1 10/2003 Ghent et al.
6,694,753 B1 2/2004 Lanz et al.
6,694,927 B1 2/2004 Pouchak et al.
6,704,401 B2 3/2004 Piepho et al.
6,778,868 B2 * 8/2004 Imamura et al. ..... 700/79
6,784,872 B1 8/2004 Matsui et al.
6,806,446 B1 10/2004 Neale
6,817,195 B2 11/2004 Rafalovich et al.
6,828,695 B1 12/2004 Hansen
6,860,431 B2 3/2005 Jayadev
6,873,876 B1 3/2005 Aisa
6,879,059 B2 4/2005 Sleva
6,904,385 B1 6/2005 Budike
6,922,598 B2 7/2005 Lim et al.
6,943,321 B2 9/2005 Carbone et al.
6,961,642 B2 11/2005 Horst
6,983,210 B2 1/2006 Matsubayashi et al.
7,010,363 B2 3/2006 Donnelly et al.
7,039,575 B2 5/2006 Juneau
7,043,380 B2 5/2006 Rodenberg et al.
7,053,790 B2 5/2006 Jang et al.
7,057,140 B2 6/2006 Pittman
7,069,090 B2 6/2006 Huffington et al.
7,082,380 B2 7/2006 Wiebe et al.
7,110,832 B2 9/2006 Ghent
7,155,305 B2 12/2006 Hayes et al.
7,164,851 B2 1/2007 Sturm et al.
7,206,670 B2 4/2007 Pimputkar et al.
7,266,962 B2 9/2007 Montuoro et al.
7,274,973 B2 9/2007 Nichols et al.
7,274,975 B2 9/2007 Miller et al.
7,368,686 B2 5/2008 Etheredge et al.
7,372,002 B2 5/2008 Nakamura et al.
7,420,140 B2 9/2008 Lenhart et al.
7,420,293 B2 9/2008 Donnelly et al.
7,446,646 B2 11/2008 Huomo
7,478,070 B2 1/2009 Fukui et al.
7,541,941 B2 6/2009 Bogolea et al.
7,561,977 B2 7/2009 Horst et al.
7,565,813 B2 7/2009 Pouchak
7,685,849 B2 3/2010 Worthington
7,720,035 B2 5/2010 Oh et al.
7,751,339 B2 7/2010 Melton et al.
7,783,390 B2 8/2010 Miller
7,919,729 B2 4/2011 Hsu
7,925,388 B2 4/2011 Ying
7,962,248 B2 6/2011 Flohr
7,991,513 B2 8/2011 Pitt
8,024,073 B2 9/2011 Imes et al.
8,027,752 B2 9/2011 Castaldo et al.
8,033,686 B2 10/2011 Recker et al.
8,094,037 B2 1/2012 Unger
8,185,252 B2 5/2012 Besore
8,190,302 B2 5/2012 Burt et al.
8,355,748 B2 1/2013 Abe et al.
8,367,984 B2 2/2013 Besore et al.
2001/0025349 A1 9/2001 Sharood et al.
2001/0048361 A1 12/2001 Mays et al.
2002/0024332 A1 2/2002 Gardner
2002/0071689 A1 6/2002 Miyamoto
2002/0125246 A1 9/2002 Cho et al.
2002/0175806 A1 11/2002 Marneweck et al.
2002/0196124 A1 12/2002 Howard et al.
2002/0198629 A1 12/2002 Ellis
2003/0036820 A1 2/2003 Yellepeddy et al.
2003/0043845 A1 3/2003 Lim et al.
2003/0178894 A1 9/2003 Ghent
2003/0193405 A1 10/2003 Hunt et al.
2003/0194979 A1 10/2003 Richards et al.
2003/0233201 A1 12/2003 Horst et al.
2004/0024483 A1 2/2004 Holcombe
2004/0034484 A1 2/2004 Solomita et al.
2004/0098171 A1 5/2004 Horst
2004/0100199 A1 5/2004 Yang
2004/0107510 A1 6/2004 Buckroyd et al.
2004/0112070 A1 6/2004 Schanin
2004/0117330 A1 6/2004 Ehlers et al.
2004/0118008 A1 6/2004 Jeong et al.
2004/0128266 A1 7/2004 Yellepeddy et al.
2004/0133314 A1 7/2004 Ehlers et al.
2004/0139038 A1 7/2004 Ehlers et al.
2004/0254654 A1 * 12/2004 Donnelly et al. ..... 700/22
2005/0011205 A1 1/2005 Holmes et al.
2005/0134469 A1 6/2005 Odorcic et al.
2005/0138929 A1 6/2005 Enis et al.
2005/0173401 A1 8/2005 Bakanowski et al.
2005/0184046 A1 8/2005 Sterling
2005/0190074 A1 9/2005 Cumeralto et al.
2006/0031180 A1 2/2006 Tamarkin et al.
2006/0036338 A1 2/2006 Harkcom et al.
2006/0068728 A1 3/2006 Ishidoshiro et al.
2006/0095164 A1 5/2006 Donnelly et al.
2006/0123807 A1 6/2006 Sullivan et al.
2006/0159043 A1 7/2006 Delp et al.
2006/0190139 A1 8/2006 Reaume et al.
2006/0208570 A1 9/2006 Christian et al.
2006/0272830 A1 12/2006 Fima et al.
2006/0276938 A1 12/2006 Miller
2006/0289436 A1 12/2006 Carbone et al.
2007/0005195 A1 1/2007 Pasquale et al.
2007/0030116 A1 2/2007 Feher
2007/0043478 A1 2/2007 Ehlers et al.
2007/0136217 A1 6/2007 Johnson et al.
2007/0151311 A1 * 7/2007 McAllister et al. ..... 68/3 R
2007/0185675 A1 8/2007 Papamichael et al.
2007/0203860 A1 8/2007 Golden et al.
2007/0213880 A1 9/2007 Ehlers

| | | | | |
|---|---|---|---|---|
| 2007/0220907 | A1 | 9/2007 | Ehlers | |
| 2007/0229236 | A1 | 10/2007 | Mercer et al. | |
| 2007/0271006 | A1* | 11/2007 | Golden et al. | 700/295 |
| 2007/0276547 | A1 | 11/2007 | Miller | |
| 2008/0029081 | A1 | 2/2008 | Gagas et al. | |
| 2008/0034768 | A1 | 2/2008 | Pimentel et al. | |
| 2008/0083729 | A1 | 4/2008 | Etheredge et al. | |
| 2008/0106147 | A1 | 5/2008 | Caggiano et al. | |
| 2008/0120790 | A1 | 5/2008 | Ashrafzadeh | |
| 2008/0122585 | A1 | 5/2008 | Castaldo et al. | |
| 2008/0136581 | A1 | 6/2008 | Heilman et al. | |
| 2008/0144550 | A1 | 6/2008 | Makhlouf et al. | |
| 2008/0167756 | A1 | 7/2008 | Golden et al. | |
| 2008/0167931 | A1 | 7/2008 | Gerstemeier et al. | |
| 2008/0172312 | A1 | 7/2008 | Synesiou et al. | |
| 2008/0177678 | A1 | 7/2008 | Di Martini et al. | |
| 2008/0179052 | A1 | 7/2008 | Kates | |
| 2008/0204240 | A1 | 8/2008 | Hilgers et al. | |
| 2008/0215263 | A1 | 9/2008 | Flohr | |
| 2008/0258633 | A1 | 10/2008 | Voysey | |
| 2008/0272934 | A1 | 11/2008 | Wang et al. | |
| 2008/0277487 | A1 | 11/2008 | Mueller et al. | |
| 2009/0006878 | A1 | 1/2009 | Borghetti et al. | |
| 2009/0038369 | A1 | 2/2009 | Vondras | |
| 2009/0063257 | A1 | 3/2009 | Zak et al. | |
| 2009/0105888 | A1 | 4/2009 | Flohr et al. | |
| 2009/0146838 | A1 | 6/2009 | Katz | |
| 2009/0171862 | A1 | 7/2009 | Harrod et al. | |
| 2009/0235675 | A1 | 9/2009 | Chang et al. | |
| 2009/0240381 | A1 | 9/2009 | Lane | |
| 2009/0326728 | A1 | 12/2009 | Chrisop et al. | |
| 2010/0017242 | A1 | 1/2010 | Hamilton et al. | |
| 2010/0070091 | A1 | 3/2010 | Watson et al. | |
| 2010/0092625 | A1 | 4/2010 | Finch et al. | |
| 2010/0131117 | A1* | 5/2010 | Mattiocco et al. | 700/295 |
| 2010/0175719 | A1 | 7/2010 | Finch et al. | |
| 2010/0179708 | A1 | 7/2010 | Watson et al. | |
| 2010/0262963 | A1 | 10/2010 | Wassermann et al. | |
| 2010/0301774 | A1 | 12/2010 | Chemel et al. | |
| 2011/0001438 | A1 | 1/2011 | Chemel et al. | |
| 2011/0062142 | A1 | 3/2011 | Steurer | |
| 2011/0085287 | A1 | 4/2011 | Ebrom et al. | |
| 2011/0087382 | A1 | 4/2011 | Santacatterina et al. | |
| 2011/0095017 | A1 | 4/2011 | Steurer | |
| 2011/0106328 | A1 | 5/2011 | Zhou et al. | |
| 2011/0114627 | A1 | 5/2011 | Burt | |
| 2011/0123179 | A1 | 5/2011 | Roetker et al. | |
| 2011/0148390 | A1 | 6/2011 | Burt et al. | |
| 2011/0181114 | A1 | 7/2011 | Hodges et al. | |
| 2011/0290781 | A1 | 12/2011 | Burt et al. | |
| 2012/0054123 | A1 | 3/2012 | Broniak et al. | |

FOREIGN PATENT DOCUMENTS

| | | | |
|---|---|---|---|
| EP | 1496324 | A1 | 1/2005 |
| GB | 2105127 | A | 3/1983 |
| JP | 11313441 | A2 | 11/1999 |
| KR | 20060085711 | A | 7/2006 |
| WO | 86/00976 | A1 | 2/1986 |
| WO | 90/12261 | A1 | 10/1990 |
| WO | 98/48335 | A1 | 10/1998 |
| WO | WO 2007060059 | A1 * | 5/2007 |
| WO | 2007136456 | A2 | 11/2007 |

OTHER PUBLICATIONS

International Search Report from PCT Application No. PCT/US2009/056878, Nov. 17, 2009.

International Search Report from PCT Application No. PCT/US2009/056882, Nov. 4, 2009.

International Search Report from PCT Application No. PCT/US2009/056883, Oct. 26, 2009.

International Search Report from PCT Application No. PCT/US2009/056886, Nov. 5, 2009.

International Search Report from PCT Application No. PCT/US2009/056889, Nov. 10, 2009.

International Search Report from PCT Application No. PCT/US2009/056894, Nov. 13, 2009.

International Search Report from PCT Application No. PCT/US2009/056895, Nov. 9, 2009.

International Search Report from PCT Application No. PCT/US2009/056901, Nov. 10, 2009.

International Search Report from PCT Application No. PCT/US2009/056906, Nov. 10, 2009.

International Search Report from PCT Application No. PCT/US2009/056913, Nov. 10, 2009.

International Search Report from PCT Application No. PCT/US2009/056914, Nov. 2, 2009.

Search Report from EP Application No. 10153695.1, May 24, 2012.

Real-Time Feedback, Natural Resources Canada via website www.nrcan.gc.ca , 2008, http://oee.nrcan.gc.ca/publications/equipment/10918.

International Search Report from PCT Application No. PCT/US2009/056911, Mar. 10, 2010.

Lemay et al., An Integrated Architecture for Demand Response Communications and Control, University of Illinois Urbana-Champaign, Oct. 28, 2008.

Search Report from CN Application No. 201010135268.8 dated Oct. 24, 2012.

Weisstein, Eric W. "At Least One.", From MathWorld—A Wolfram Web Resource, http://mathworld.com/AtLeastOne.html, p. 1,

* cited by examiner

CLOTHES WASHER DEMAND RESPONSE WITH DUAL WATTAGE OR AUXILIARY HEATER

CROSS REFERENCE TO RELATED APPLICATIONS

The present application is a continuation-in-part application and claims priority from U.S. patent application Ser. No. 12/559,751, filed 15 Sep. 2009, which application is expressly incorporated herein by reference in its entirety.

BACKGROUND OF THE DISCLOSURE

This disclosure relates to energy management, and more particularly to energy management of household consumer appliances. The present disclosure finds particular application to energy management of a clothes washer appliance, and is also referred to as a clothes washer demand response.

Currently, utilities charge a flat rate. Increasing costs of fuel prices and high energy use during certain parts of the day make it highly likely that utilities will begin to require customers to pay a higher rate during peak demand. Accordingly, a potential cost savings is available to the homeowner by managing energy use of various household appliances, particularly during the peak demand periods. As is taught in the cross-referenced applications, a controller is configured to receive and process a signal, typically from a utility, indicative of a current cost of supplied energy. The controller is configured to change the operation of an appliance from a normal mode (e.g., when the demand and cost of the energy is lowest) to an energy savings mode (which can be at various levels, e.g., medium, high, critical). Thus, various responses are desired in an effort to reduce energy consumption and the associated cost.

More particularly, the parent application noted above generally teaches adjusting operation schedule, an operation delay, an operation adjustment and a select deactivation on at least one or more power consuming features or functions to reduce power consumption of the clothes washer in the energy savings mode. For example, the operation delay may include a delay in start time, an extension of time to a delayed start, pausing an existing cycle, delaying a restart or any combination of these examples. A need exists for providing alternative courses of operation in a peak demand state where a consumer's flexibility and convenience is maximized during peak pricing events.

SUMMARY OF THE DISCLOSURE

A clothes washer includes at least one power-consuming feature, including a heater assembly. A controller is adapted to receive and process a signal from a utility indicative of the current cost of supplied energy. The controller operates the clothes washer in one of a plurality of operating modes, including at least a normal mode and an energy savings mode based on the received signal. The controller is configured to change the operation of the heater assembly for a period of time based on input received from the signal.

The heater assembly preferably includes a first heater and a second heater, or a dual wattage heater, and in the normal operating mode, only the first heater is used. In another normal operating mode, both of the first and second heaters are used, and in the energy savings mode, only one of the first and second heaters is used.

In one arrangement, the first heater has a greater wattage rating than the second heater.

In a normal operating mode, a water heating cycle is active for a shorter period of time than in the energy savings mode, and in the normal operating mode, one or both of the first and second heaters are used.

In another arrangement, only the lower wattage heater is operated during a water heating cycle in an energy savings mode.

A method of operating a clothes washer having a controller that receives and processes a signal from a utility indicative of the current cost of supplied energy includes providing a dual wattage heater assembly and operating the heater assembly at a lower wattage in the energy savings mode.

The method further includes extending a first time period of operating the selected cycle in the energy savings mode in comparison to a second time period of operating the selected cycle in the normal mode.

The present disclosure reduces the average power used by the clothes washer during peak pricing times, and/or reduces the overall energy used by the clothes washer during peak pricing times.

The present arrangement saves on costs, and adds convenience and flexibility for the consumer to deal with pricing events.

Still another benefit resides in completing the cycle faster while still shedding electrical load without having to pause or delay the cycle entirely.

Selected ones of the solutions are easy to execute, i.e., requiring only software to change the clothes washer operation as a result of received signals.

Still other benefits and advantages of this disclosure will become more apparent upon reading and understanding the following detailed description.

DETAILED DESCRIPTION OF THE PREFERRED EMBODIMENTS

Figure 1:
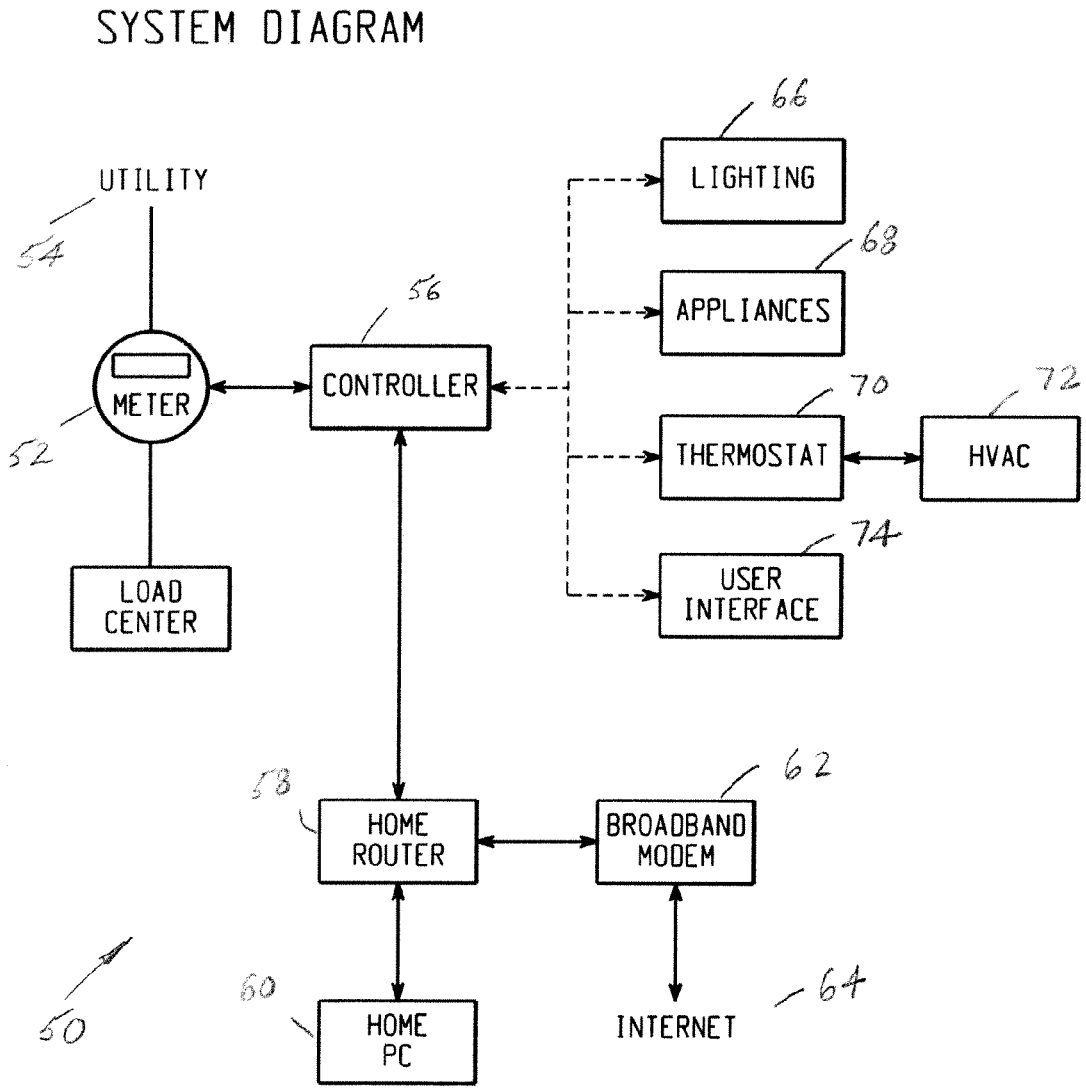
FIG. 1 is a schematic representation of an exemplary demand managed home including appliances such as a clothes washer.

FIG. 1 shows a general system diagram 50 of a utility meter 52 that communicates with utility 54 and a controller 56 that receives and processes a signal from the meter. The occurrence of peak demand and demand limit data may be communicated by the utility and through the meter to the controller. The demand limit can be set by the homeowner or consumer in some instances. Additionally, the homeowner can choose to force various modes in the appliance control based on the rate that the utility is charging. The controller may interact with a home router 58, home PC 60, broadband modem 62 or the internet 64. Preferably, the controller 56 is configured to control various items in the home, such as the lighting 66, one or more appliances 68 (including a clothes washer), the thermostat and HVAC 70, 72, respectively, and may include a user interface 74 that displays information for the homeowner and allows the homeowner to program the controller or override selected functions if so desired. This system is generally shown and described in commonly owned U.S. patent application Ser. No. 12/559,703, filed Sep. 15, 2009.

Figure 2:
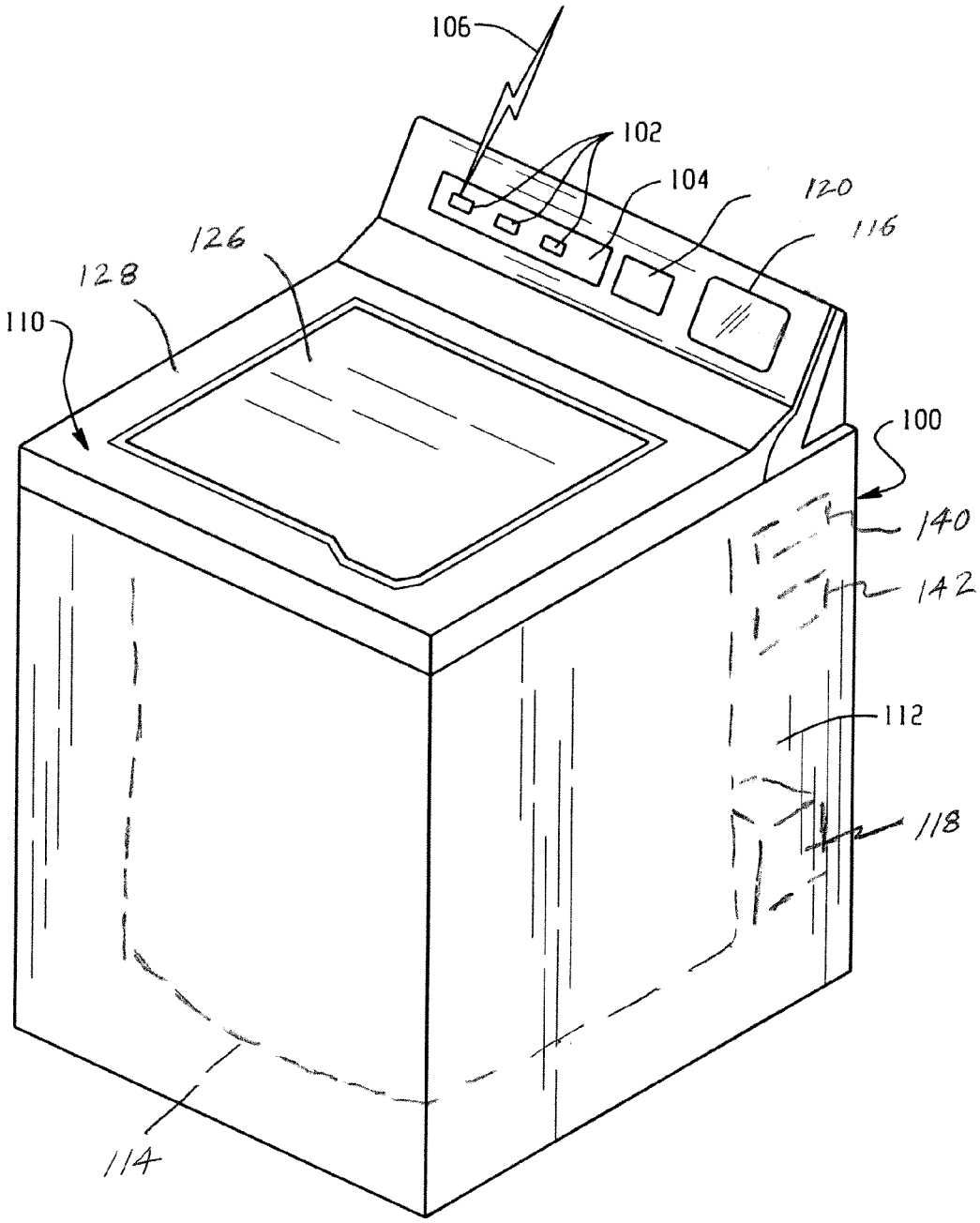
FIG. 2 is a perspective view of a clothes washer.

An exemplary embodiment of a demand managed appliance 100 is clothes washer 110 schematically illustrated in FIG. 2. The clothes washer 110 comprises at least one power consuming feature/function 102 and a controller 104 operatively associated with the power consuming feature/function. The controller 104 can include a micro computer on a printed circuit board which is programmed to selectively control the energization of the power consuming feature/function. The controller 104 is configured to receive and process a signal 106 indicative of a utility state, for example, availability and/or current cost of supplied energy. The energy signal may be generated by a utility provider, such as a power company, and can be transmitted via a power line, as a radio frequency signal, or by any other means for transmitting a signal when the utility provider desires to reduce demand for its resources. The cost can be indicative of the state of the demand for the utility's energy, for example a relatively high price or cost of supplied energy is typically associated with a peak demand state or period and a relative low price or cost is typically associated with an off-peak demand state or period.

The controller 104 can operate the clothes washer 110 in one of a plurality of operating modes, including a normal operating mode and an energy savings mode, in response to the received signal. Specifically, the clothes washer 110 can be operated in the normal mode in response to a signal indicating an off-peak demand state or period and can be operated in an energy savings mode in response to a signal indicating a peak demand state or period. As will be discussed in greater detail below, the controller 104 is configured to at least selectively adjust and/or disable the power consuming feature/function to reduce power consumption of the clothes washer 110 in the energy savings mode.

The clothes washer 110 generally includes an outer case or housing 112 and a control panel or user interface 116. The clothes washer further includes a lid pivotally mounted in the top wall. Though not shown in the drawings, clothes washer 110 includes within outer case 112, for example, a tub and/or wash basket 114 disposed for receiving clothes items to be washed, a drive system or motor 118 operatively connected to the controller and the basket 114 to tumble and/or agitate the wash load (also referred to herein as mechanical action) during wash and rinse cycles and spinning the basket during spin cycles, and a liquid distribution system comprising a water valve, for delivering water to the tub and basket and a pump for removing liquid from the tub, all of which may be of conventional design. Controller 104 is configured with a plurality of clothes washing algorithms preprogrammed in the memory to implement user selectable cycles for washing a variety of types and sizes of clothes loads. Each such cycle comprises a combination of pre-wash, wash, rinse, and spin sub-cycles. Each sub-cycle is a power consuming feature/function involving energization of a motor or other power consuming components. The amount of energy consumed by each cycle depends on the nature, number and duration of each of the sub-cycles comprising the cycle. The user interface 116 can include a display 120 and control buttons for enabling the user to make various operational selections. Instructions and selections are typically displayed on the display 120. The clothes washer further includes a door or lid 126 mounted within a top wall 128. Clothes washing algorithms can be preprogrammed in the memory accessed by the controller for many different types of cycles.

One response to a peak demand state is to delay operation, reschedule operation for a later start time, and/or alter one or more of selected functions/features in order to reduce energy demands. For example, clothes washers have the capacity to run at off-peak hours because demand is either not constant and/or the functions are such that immediate response is not necessary. However, a cost savings associated with reduced energy use during a peak demand period when energy costs are elevated must be evaluated with convenience for the consumer/homeowner. As one illustrative example, the clothes washer 110 that has been loaded during the daytime, i.e., typical peak demand period hours, can be programmed to delay operations for a later, albeit off-peak demand hours.

In order to reduce the peak energy consumed by a clothes washer, modifications and/or delays of individual clothes washer cycles can be adjusted in order to reduce the total and/or instantaneous energy consumed. Reducing total and/or instantaneous energy consumed also encompasses reducing the energy consumed at peak times and/or reducing the overall electricity demands during peak times and non-peak times.

In conjunction with the scheduling delays described above, or as separate operational changes, the following operation adjustments can be selected in order to reduce energy demands. The operation adjustments to be described hereinafter, can be implemented in conjunction with off-peak mode hours and/or can be implemented during on-peak mode hours. Associated with a clothes washer, the operational adjustments can include one or more of the following: a reduction in operating temperature (i.e. temperature set point adjustments) in one or more cycles, a disablement of one or more heaters in one or more cycles, reduction in power to one or more heaters, a switch from a selected cycle to a reduced power consumption cycle, a reduction in a duration of cycle time in one or more cycles, a disablement of one or more cycles, a skipping of one or more cycles, a reduction of water volume and/or water temperature in one or more cycles, and an adjustment to the wash additives (i.e., detergent, fabric softener, bleach, etc.) in one or more cycles. Illustratively, a switch from a selected cycle to a reduced power consumption cycle could include a change to the cycle definition when a command is received. For example, if a customer/user pushes "heavy duty wash" cycle, the selected cycle would then switch to a "regular" cycle, or the customer/user pushes "normal" cycle which would then switch to a "permanent press" cycle. As described, the switching is in response to lowering the energy demands from a selected cycle to a reduced power consumption cycle that meets a similar functional cycle.

Figure 3:
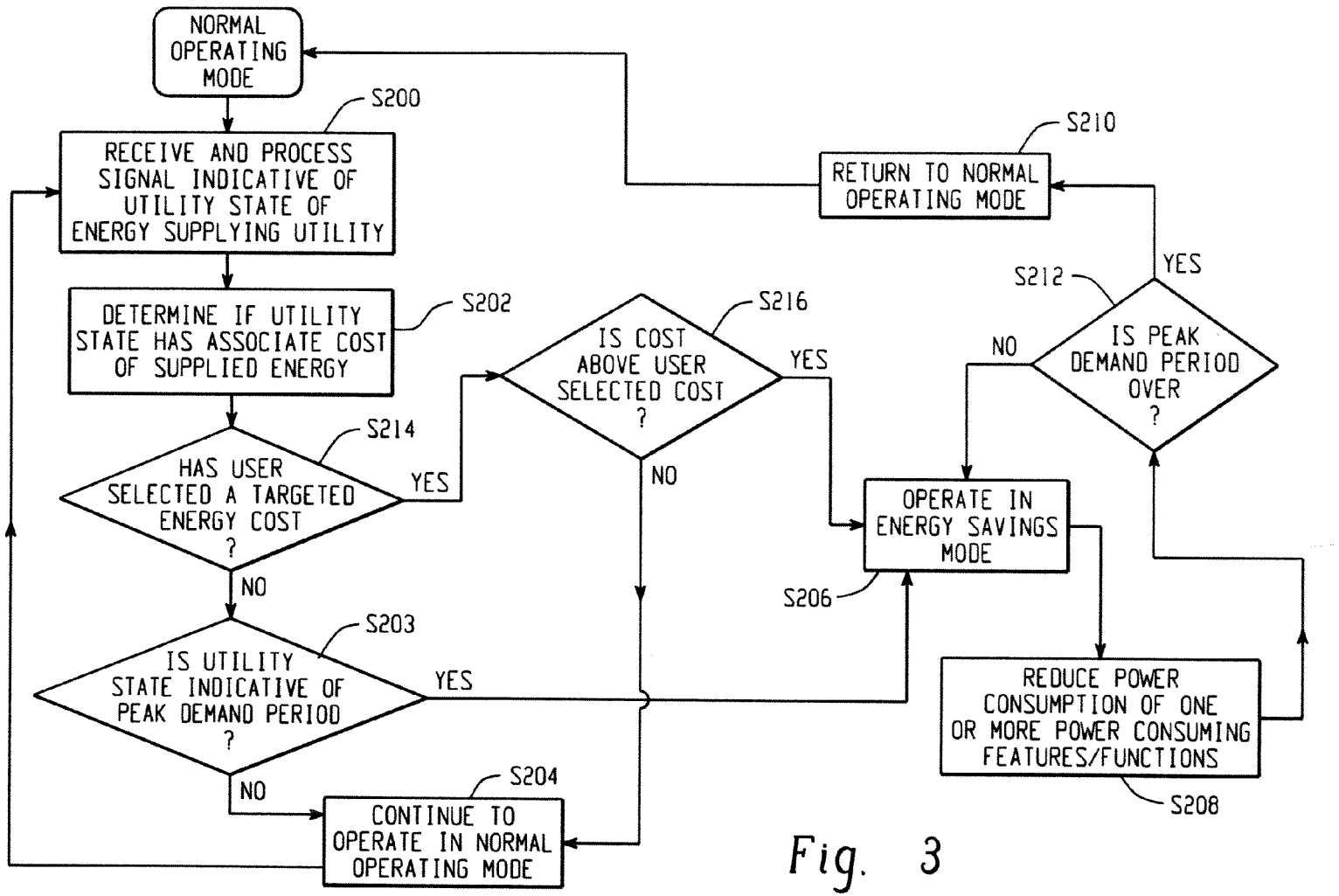
FIG. 3 is a flowchart that generally illustrates the logic associated with a demand managed appliance.

With reference to FIG. 3, a control method in accordance with the present disclosure comprises communicating with an associated utility and receiving and processing the signal indicative of cost of supplied energy (S200), determining a state for an associated energy supplying utility, such as a cost of supplying energy from the associated utility (S202), the utility state being indicative of at least a peak demand period or an off-peak demand period (S203). The method further includes operating the clothes washer 110 in a normal mode during the off-peak demand period (S204), operating the clothes washer 110 in an energy savings mode during the peak demand period (S206), selectively adjusting any number of one or more power consuming features/functions of the clothes washer to reduce power consumption of the appliance in the energy savings mode (S208), and returning to the normal mode (S210) after the peak demand period is over (S212).

It is to be appreciated that a selectable override option can be provided on the user interface 116 providing a user the ability to select which of the one or more power consuming features/functions are adjusted by the controller in the energy savings mode. The user can selectively override adjustments, whether time related or function related, to any of the power consuming functions. The operational adjustments, particularly an energy savings operation can be accompanied by a display on the panel which communicates activation of the energy savings mode. The energy savings mode display can include a display of "ECO", "Eco", "EP", "ER", "CP", "CPP", "DR", or "PP" or some other representation on the appliance display 120. In cases with displays having additional characters available, messaging can be enhanced accordingly.

Another load management program offered by an energy supplier may use price tiers which the utility manages dynamically to reflect the total cost of energy delivery to its customers. These tiers provide the customer a relative indicator of the price of energy and in one exemplary embodiment are defined as being LOW (level 1), MEDIUM (level 2), HIGH (level 3), and CRITICAL (level 4). In the illustrative embodiments the appliance control response to the LOW and MEDIUM tiers is the same namely the appliance remains in the normal operating mode. Likewise the response to the HIGH and CRITICAL tiers is the same, namely operating the appliance in the energy saving mode. However, it will be appreciated that the controller could be configured to implement a unique operating mode for each tier which provides a desired balance between compromised performance and cost savings/energy savings. If the utility offers more than two rate/cost conditions, different combinations of energy saving control steps may be programmed to provide satisfactory cost savings/performance tradeoff. The operational and functional adjustments described above, and others, can be initiated and/or dependent upon the tiers. For example, the clothes washer 110 hot water selection can be prevented or 'blocked' from activating if the pricing tier is at level 3 or 4. The display 120 can include an audible and visual alert of pricing tier 3 and 4. Some communication line with the utility can be established including, but not limited to, the communication arrangements hereinbefore described. In addition, the display 120 can provide the actual cost of running the appliance in the selected mode of operation, as well as, maintain a running display of the present cost of energy. If the utility offers more than two rate/cost conditions, different combinations of energy saving control steps may be programmed to provide satisfactory cost savings/performance tradeoff.

Figure 4:
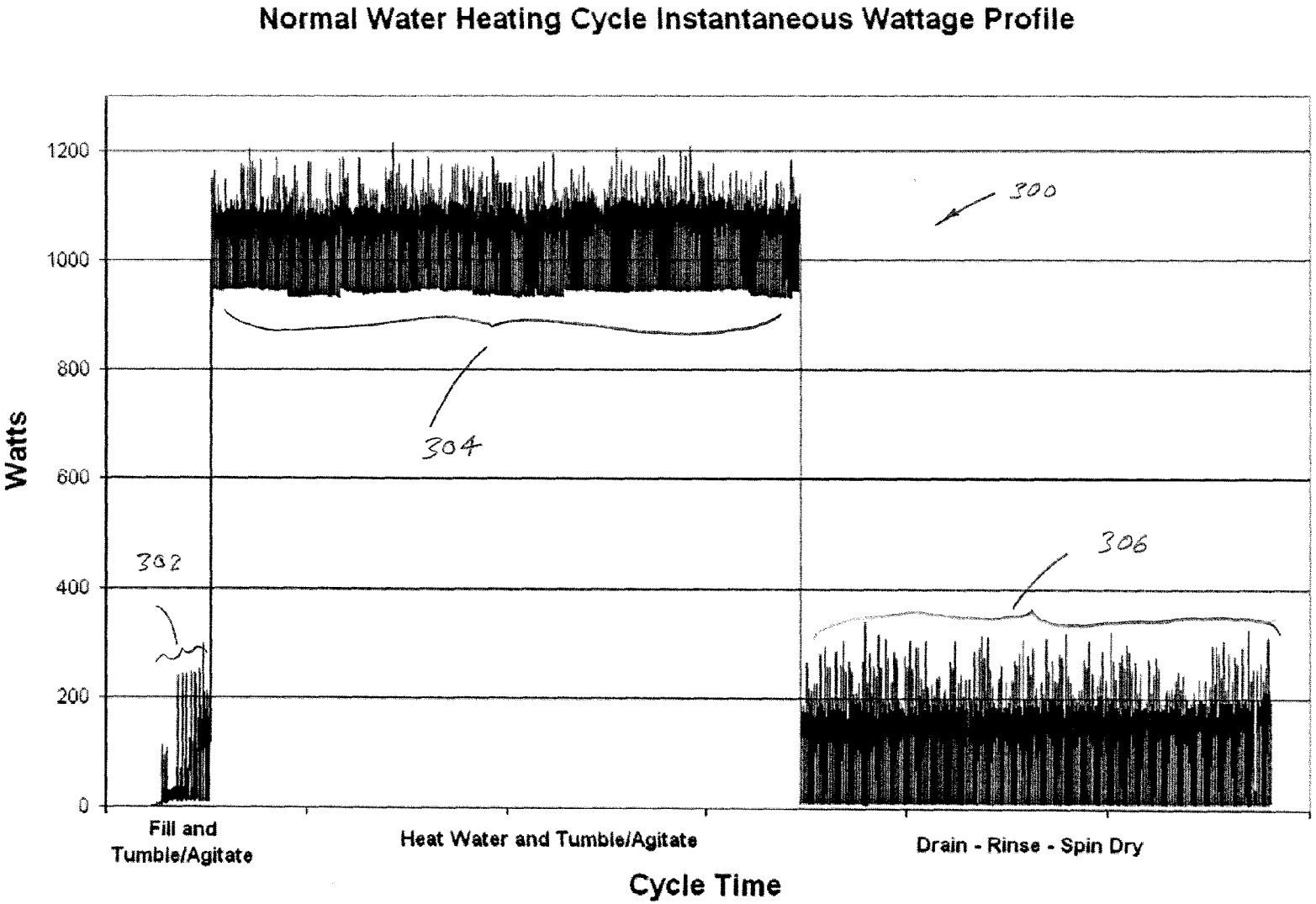
FIG. 4 is a graphical representation of the instantaneous wattage profile for a typical washing machine cycle incorporating a heater.
Figure 5:
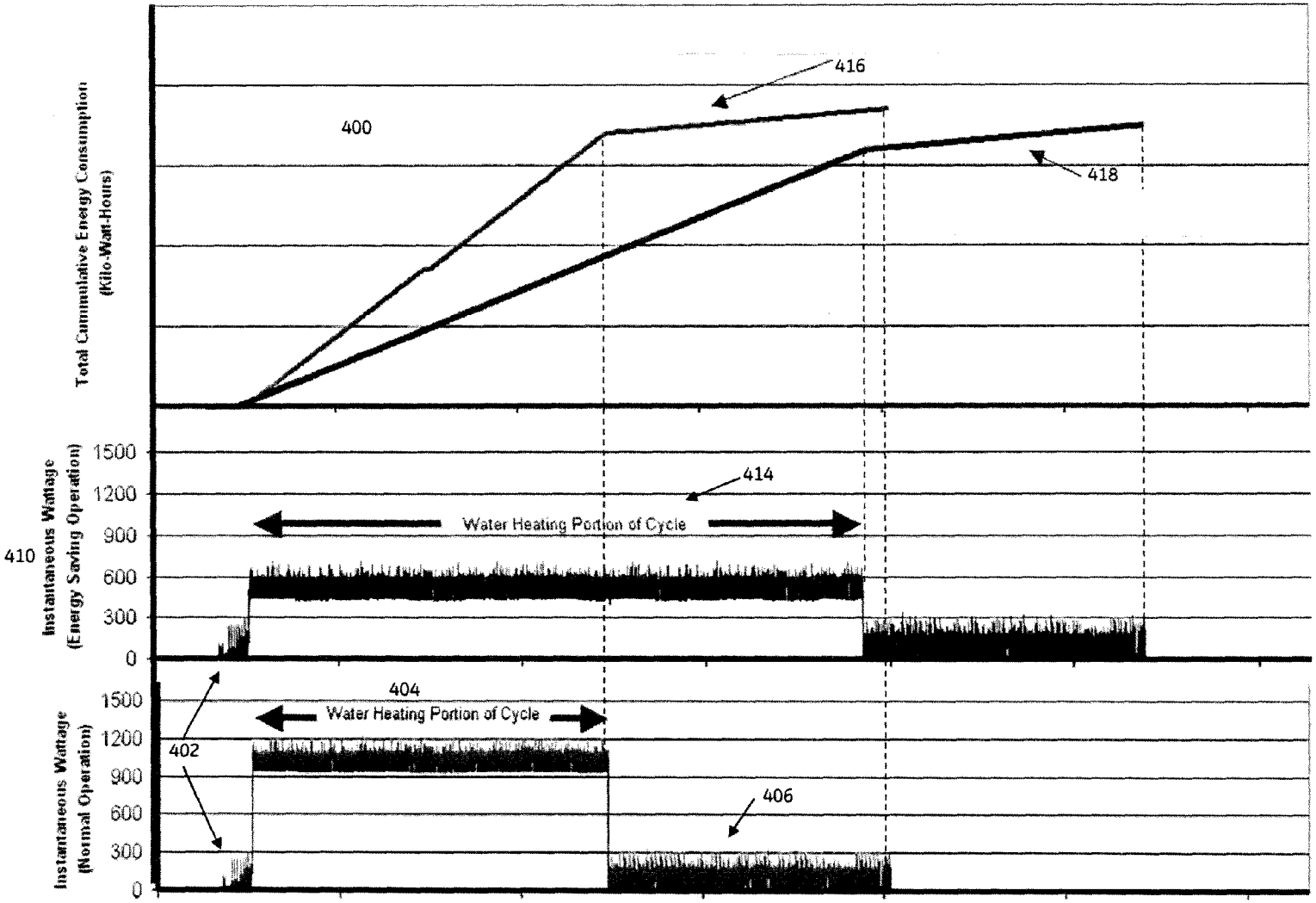
FIG. 5 is a graphical illustration of use of a dual wattage heater and the associated impact on average energy and total energy used.

Turning next to FIGS. 4 and 5, some clothes washers are provided with a sanitization or sanitizing cycle in which a heater elevates the water temperature in the clothes washer above 140° F., and preferably to approximately 140°-150° F., for an extended time period, e.g., on the order of 30-60 minutes. This is represented in FIG. 4, where the instantaneous wattage profile 300 of a wash cycle that includes a sanitizing cycle (also generally referred to as water heating) is illustrated. After a fill and tumble/agitate portion 302 of the wash cycle, the water is then heated and then further tumbled/agitated in the sanitizing portion 304 of the wash cycle where energy use in the exemplary embodiment is on the order of 900-1,200 watts. Once the water heating portion 304 of the wash cycle is complete, a remainder 306 of the wash cycle, i.e., drain, rinse, and spin dry, is completed.

As shown in FIG. 4, the most energy intensive portion of the wash cycle is associated with the sterilization or sanitization portion 304. One response in a peak pricing period is to disable the water heating cycle, i.e., not allow the sanitizing portion of the wash cycle to be activated or alternatively delay the wash cycle, although such delay may be on the order of many hours. Although both of these options provide potential cost savings to the user/homeowner, these options are generally viewed as a potential inconvenience. On the other hand, there is an option of allowing the clothes washer to operate in the normal mode, i.e., run the water heating portion of the wash cycle during the peak demand period. As will be appreciated from FIG. 4, however, this has the potential to result in a cost increase for the consumer during a peak demand.

Two potential solutions simultaneously satisfy a desire to save energy and reduce costs while also limiting the inconvenience to the homeowner. For example, as illustrated in FIG. 5, use of a dual wattage heater (a single heater with two different wattages) operated at a reduced wattage level, or a second, low wattage heater (having a lower wattage than the first, primary heater) can result in significant energy savings during operation when compared to the primary heater in the sanitizing portion of the wash cycle. The first heater (or dual wattage heater if no second heater is provided) is schematically represented in FIG. 2 by reference numeral 140 and the second heater identified as 142. Instantaneous wattage plot 400 is similar to the profile 300 of FIG. 4 that shows energy used in a normal mode of operation. Particularly, portion 402 is representative of the energy incurred during the fill and tumble/agitate portions of the wash cycle. Normal water heating in the sanitizing cycle (region 404 of the plot) has instantaneous wattage levels ranging between approximately 950 to approximately 1,200 watts although it will be understood that the particular wattage values may vary from one clothes washer to another and that these wattage ranges are merely representative values. Thereafter, the third portion 406 of the graph of the normal mode of operation is representative of the energy associated with the drain, rinse, and spin dry features of the wash cycle, similar to graph portion 306 in FIG. 4.

If a dual wattage heater is provided in the clothes washer, or alternatively a second, lower wattage heater 142 is used, then lower wattage heater operation will result in a substantial reduction in instantaneous wattage used during the wash cycle, and particularly during the sanitizing portion of the wash cycle. Thus, plot 410 represents the instantaneous wattage during this energy savings mode of operation that uses the low wattage heater to heat the water. The instantaneous wattage ranges, for example, between 450 and 700 watts as shown in region 412 of the plot 410. It will also be appreciated that the reduced instantaneous wattage will take longer to heat the water to the desired temperature and thus this portion 412 of the graph, when compared to 404 representative of instantaneous wattage during normal operation with a higher wattage heater, is substantially extended. In this slower heating arrangement the cycle time is longer but there is a slight reduction in the cost and total energy consumption as evident from a comparison of total energy consumption during normal operation represented by plot 416 and the total energy consumption during the energy saving operation using the low wattage heater as represented by plot 418.

It is believed that a dual wattage heater where the first and second wattage ratings are used for the same function (heating of the water), or alternatively use of a second heater having a lower wattage rating than the first heater and again used for the same function (such as heating the water), has not been used in a clothes washers. This is contrasted with a dual wattage heater or use of a second heater for use with a different function, e.g., a steam cycle. The concept of the present disclosure allows a washer cycle to employ a heater for use with a sanitize cycle to be completed without undue delay and while still benefiting the grid and saving the consumer money even if the consumer does not want to wait. Although the cycle time will be longer than compared to the normal mode of operation, the wash cycle will not itself be delayed (inactive) during these critical time periods. Using the lower wattage heater during the costly operation times minimizes the cost impact of running a sanitization cycle if the consumer wants to run the cycle at an expensive time period. The required temperature used in a sanitization cycle can still be achieved and adequately treat various soiled garments or laundry items.

In addition, if the DSM signal reduces to a non-high or a non-peak level during the extended heating cycle, the controller 104 can be configured to allow the clothes washer to return to the normal operation mode or could continue with the energy savings mode of operation until the wash cycle is complete The disclosure has been described with reference to the preferred embodiments. Obviously, modifications and alterations will occur to others upon reading and understanding the preceding detailed description. It is intended that the invention be construed as including all such modifications and alterations.

What is claimed is:

1. A clothes washer comprising:

at least one power consuming feature including a heater assembly comprising a first heater and a second heater for heating water to be used during a sanitation portion of a wash cycle, the first heater having a greater wattage rating than the second heater; and a controller adapted to receive and process a signal indicative of the current cost of supplied energy, the controller operating the clothes washer in one of a plurality of operating modes including at least a normal mode and an energy saving mode based on the received signal, wherein, in response to the normal mode, the controller activates the first heater and de-activates the second heater, and wherein, in response to the energy saving mode, the controller implements an extended heating cycle in which the controller de-activates the first heater and activates the second heater to raise the temperature of water required for the sanitation portion of the wash cycle.

2. The clothes washer of claim 1 wherein the heater assembly is operatively associated with a water heating cycle of the clothes washer.

3. The clothes washer of claim 2 wherein in the normal the water heating cycle is active for a shorter period of time than in the energy saving mode.

4. The clothes washer of claim 3 wherein in the normal mode the heater assembly is operated at a higher wattage than in the energy saving mode.

* * * * *

UNITED STATES PATENT AND TRADEMARK OFFICE

CERTIFICATE OF CORRECTION

PATENT NO. : 8,522,579 B2
APPLICATION NO. : 12/899920
DATED : September 3, 2013
INVENTOR(S) : Kappler It is certified that error appears in the above-identified patent and that said Letters Patent is hereby corrected as shown below:

In the Claims

In Column 8, Line 19, in Claim 3, delete “the normal” and insert -- the normal mode --, therefor.

Signed and Sealed this
Seventeenth Day of December, 2013

Margaret A. Focarino

Margaret A. Focarino
*Commissioner for Patents of the United States Patent and Trademark Office*